US011147431B2

(12) United States Patent
Fawaz et al.

(10) Patent No.: US 11,147,431 B2
(45) Date of Patent: Oct. 19, 2021

(54) DETERGENT DISPENSER FOR A DISHWASHER

(71) Applicant: Midea Group Co., Ltd., Foshan (CN)

(72) Inventors: Bassam Fawaz, Louisville, KY (US); Robert M. Digman, Goshen, KY (US); Joel Boyer, Louisville, KY (US); Russell Dietrich, Taylorsville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 78 days.

(21) Appl. No.: 16/448,798

(22) Filed: Jun. 21, 2019

(65) Prior Publication Data

US 2020/0397219 A1 Dec. 24, 2020

(51) Int. Cl.
*A47L 15/44* (2006.01)

(52) U.S. Cl.
CPC ..... *A47L 15/4472* (2013.01); *A47L 15/4409* (2013.01); *A47L 15/4463* (2013.01)

(58) Field of Classification Search
None
See application file for complete search history.

(56) References Cited

U.S. PATENT DOCUMENTS

| | | | | |
|---|---|---|---|---|
| 3,212,675 | A | 10/1965 | Thomas | |
| 3,233,778 | A | 2/1966 | Cobb | |
| 4,938,125 | A | 7/1990 | Wong | |
| 6,540,081 | B2 | 4/2003 | Balz et al. | |
| 7,472,710 | B2 | 1/2009 | Jowett et al. | |
| 8,146,610 | B2 | 4/2012 | Gibis et al. | |
| 8,221,696 | B2 | 7/2012 | Brandt et al. | |
| 8,338,357 | B2 | 12/2012 | Gibis et al. | |
| 8,506,896 | B2 | 8/2013 | Hofte et al. | |
| 8,651,336 | B2 | 2/2014 | Gadini et al. | |
| 2002/0108969 | A1* | 8/2002 | Rodd | D06F 58/203 222/209 |
| 2004/0088796 | A1* | 5/2004 | Neergaard | D06F 58/203 8/158 |
| 2005/0082308 | A1 | 4/2005 | Simson | |
| 2008/0293604 | A1* | 11/2008 | Gibis | A47L 15/4472 510/220 |
| 2010/0104488 | A1* | 4/2010 | Housmekerides | A47L 15/4463 422/261 |

(Continued)

FOREIGN PATENT DOCUMENTS

| | | | | |
|---|---|---|---|---|
| CN | 104631056 A | | 5/2015 | |
| CN | 109199297 A | * | 1/2019 | A47L 15/4463 |

(Continued)

OTHER PUBLICATIONS

Finish Quantumatic Finish Quantumatic Automatic Dishwasher Detergent Dispenser System by Finish, https://www.amazon.com/Finish-Quantumatic-Automatic-Dishwasher-Detergent/dp/B003GEQVTQ, Retrieved on Apr. 20, 2020.

*Primary Examiner* — Irina Graf
(74) *Attorney, Agent, or Firm* — Middleton Reutlinger

(57) ABSTRACT

A detergent dispenser may dispense detergent into a wash tub of a household appliance. The detergent dispenser may include a blister pack with a plurality of detergents. One or more rotating members may be used to expel the detergent from the blister pack through one or more outlets. The one or more rotating members may include one or more actuators.

26 Claims, 13 Drawing Sheets

(56) References Cited

U.S. PATENT DOCUMENTS

| | | | | |
|---|---|---|---|---|
| 2011/0087367 | A1 | 4/2011 | Gadini et al. | |
| 2011/0189060 | A1 | 8/2011 | Van Loyen et al. | |
| 2011/0259368 | A1 | 10/2011 | Hofte et al. | |
| 2011/0272435 | A1* | 11/2011 | Brandt | A47L 15/4445 222/144.5 |
| 2016/0145548 | A1* | 5/2016 | Van Tol | A47L 15/4445 510/221 |

FOREIGN PATENT DOCUMENTS

| | | | |
|---|---|---|---|
| DE | 10158604 | A1 | 6/2003 |
| DE | 102004020476 | A1 | 11/2005 |
| DE | 102010003775 | A1 | 10/2011 |
| GB | 2386129 | A | 9/2003 |
| WO | WO2003073906 | A1 | 9/2003 |
| WO | WO2010142723 | A1 | 12/2010 |
| WO | WO2012025315 | A1 | 3/2012 |
| WO | WO2013113576 | A1 | 8/2013 |
| WO | WO2017050538 | A1 | 3/2017 |

* cited by examiner

DETERGENT DISPENSER FOR A DISHWASHER

BACKGROUND

Dishwashers are used in many single-family and multi-family residential applications to clean dishes, silverware, cutlery, cups, glasses, pots, pans, etc. (collectively referred to herein as "utensils"). Most conventional dishwashers rely on a single-use detergent dispenser, often located on the interior of the door of the dishwasher. Such conventional dispensers include an opening allowing for a volume of liquid, powder, or dissolvable pod or capsule detergent to be loaded for a single wash. During a wash cycle such a dispenser is opened allowing the entirety of the contents of be expelled; as such, a user is required to reload the dispenser before each wash cycle is started. In certain instances, it may be desirable to minimize the number of times a user is required to fill the detergent dispenser. A need therefore exists in the art for a multi-use dispenser.

SUMMARY

The herein-described embodiments address these and other problems associated with the art by providing a dishwasher using a multiple use detergent dispenser. In some embodiments of the invention, for example, a dishwasher may include a wash tub and a detergent dispenser. In various embodiments, the detergent dispenser may be positioned in the wash tub to dispense detergent into the wash tub. In addition, in some embodiments, the detergent dispenser may include a stationary circular blister pack having a plurality of detergents arranged about a rotational axis. In some embodiments, the detergent dispenser may include a backing plate adjacent one side of the circular blister pack and having one or more outlets in fluid communication with the wash tub. In various embodiments, the detergent dispenser may include one or more rotating members adjacent the other side of the circular blister pack. In some embodiments, the one or more rotating members rotate about the rotational axis. Moreover, in various embodiments, the detergent dispenser may include one or more drive mechanisms rotating the one or more rotating members about the rotational axis between a plurality of rotational positions, and wherein one or more of the plurality of rotational positions may orientate the one or more rotating members proximate the plurality of detergents and the one or more outlets to dispense detergent into the wash tub.

In some embodiments, the one or more rotating members may include one or more rollers rotated to the plurality of rotational positions to dispense detergent into the wash tub through the one or more outlets. In various embodiments, the one or more rotating members may include one or more actuators rotated to the plurality of rotational positions to dispense detergent into the wash tub through the one or more outlets. Moreover, in some embodiments, the one or more actuators may extend the one or more rotating members between a first radial length and a second radial length, wherein the first radial length is larger than the second radial length. In various embodiments, the one or more actuators may extend at least a portion of the one or more rotating members in a direction parallel to the rotational axis towards the circular blister pack between a first length and a second length, wherein the second length may be larger than the first length. In some embodiments, the one or more rotating members may include a first rotating member and a second rotating member, wherein the first rotating member may be longer than the second rotating member, wherein the first rotating member may engage the plurality of detergents at a first radial distance from the rotational axis and the second rotating member may engage the plurality of detergents at a second radial distance, and wherein the first radial distance may be larger than the second radial distance. In various embodiments, the one or more rotating members may include a first rotating member and a second rotating member, and the first rotating member may rotate independently from the second rotating member. In some embodiments, the backing plate may rotate about the rotational axis. In addition, in some embodiments, the backing plate may include a blade proximate the one or more outlets.

In addition, in some embodiments, a dishwasher may include a wash tub and a detergent dispenser positioned in the wash tub to dispense detergent into the wash tub. In various embodiments, the detergent dispenser may include a motor with a rotating shaft defining a rotational axis. In some embodiments, the detergent dispenser may include a stationary circular blister pack having a plurality of detergents arranged about the rotational axis. In various embodiments, the detergent dispenser may include a backing plate adjacent one side of the circular blister pack and may have one or more outlets in fluid communication with the wash tub. In addition, in some embodiments, the detergent dispenser may include one or more rotating members adjacent the other side of the circular blister pack, each one of the one or more rotating members may have a first end engaging the shaft of the motor and a second end projecting radially outward therefrom, wherein the one or more rotating members rotate with the shaft about the rotational axis. In various embodiments, the shaft of the motor may rotate the second end of the one or more rotating members between a plurality of rotational positions, and wherein one or more of the plurality of rotational positions may orientate the one or more rotating members proximate the plurality of detergents and the one or more outlets to dispense detergent into the wash tub.

In some embodiments, the one or more rotating members may include a first rotating member with a roller proximate the second end. In various embodiments, the first rotating member may include an actuator, wherein the actuator extends the first rotating member between a first radial length and a second radial length, wherein the first radial length is larger than the second radial length. Moreover, in some embodiments, the one or more rotating members may include a second rotating member with a roller proximate the second end. In various embodiments, the second rotating member may include a radial length shorter than the first rotating member. In some embodiments, each of the first rotating member and the second rotating member may include a one-way bearing engaging the shaft, wherein the first rotating member rotates only in a first rotational direction and the second rotating member rotates only in a second rotational direction different from the first rotational direction. In various embodiments, the backing plate may engage the shaft and may rotate between a plurality of rotational positions positioning the one or more outlets proximate the one or more rotating members. In addition, in some embodiments, the one or more rotating members may include a first rotating member having one or more actuators proximate the second end, wherein the one or more actuators may extend at least a portion of the first rotating member in a direction parallel to the rotational axis towards the circular blister pack between a first length and a second length, wherein the second length is larger than the first length and when in the first length the first rotating member is disengaged from the plurality of detergents and when in the second length the first rotating member engages the plurality of detergents. In various embodiments, the one or more actuators may include a first actuator and a second actuator, wherein the first actuator may be positioned at a first radial distance from the rotational axis and the second actuator may be positioned at a second radial distance from the rotational axis less than the first radial distance. In some embodiments, the backing plate may rotate with the shaft of the motor about the rotational axis.

In some embodiments, a detergent dispenser may be positioned to dispense detergent into a household appliance. In various embodiments, the detergent dispenser may include a motor with a rotating shaft defining a rotational axis. In addition, in some embodiments, the detergent dispenser may include a stationary circular blister pack having a plurality of detergents arranged about the rotational axis. In various embodiments, the detergent dispenser may include a backing plate adjacent one side of the circular blister pack and may have one or more outlets in fluid communication with a wash tub. Moreover, in some embodiments, the detergent dispenser may include one or more elongated rotating members adjacent the other side of the circular blister pack, each one of the one or more elongated rotating members may have a first end engaging the shaft of the motor and a second end projecting radially outward therefrom wherein the one or more elongated rotating members rotate with the shaft about the rotational axis. In various embodiments, the shaft of the motor may rotate the second end of the one or more elongated rotating members between a plurality of rotational positions, and wherein one or more of the plurality of rotational positions may orientate the one or more elongated rotating members proximate the plurality of detergents and the one or more outlets to dispense detergent into a wash tub.

In other aspects, the backing plate may rotate with the shaft of the motor about the rotational axis. In some embodiments, the one or more elongated rotating members may include one or more actuators to vary a radial length, vary an axial length parallel to the rotational axis, or both to dispense one or more of the plurality of detergents.

These and other advantages and features, which characterize the invention, are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
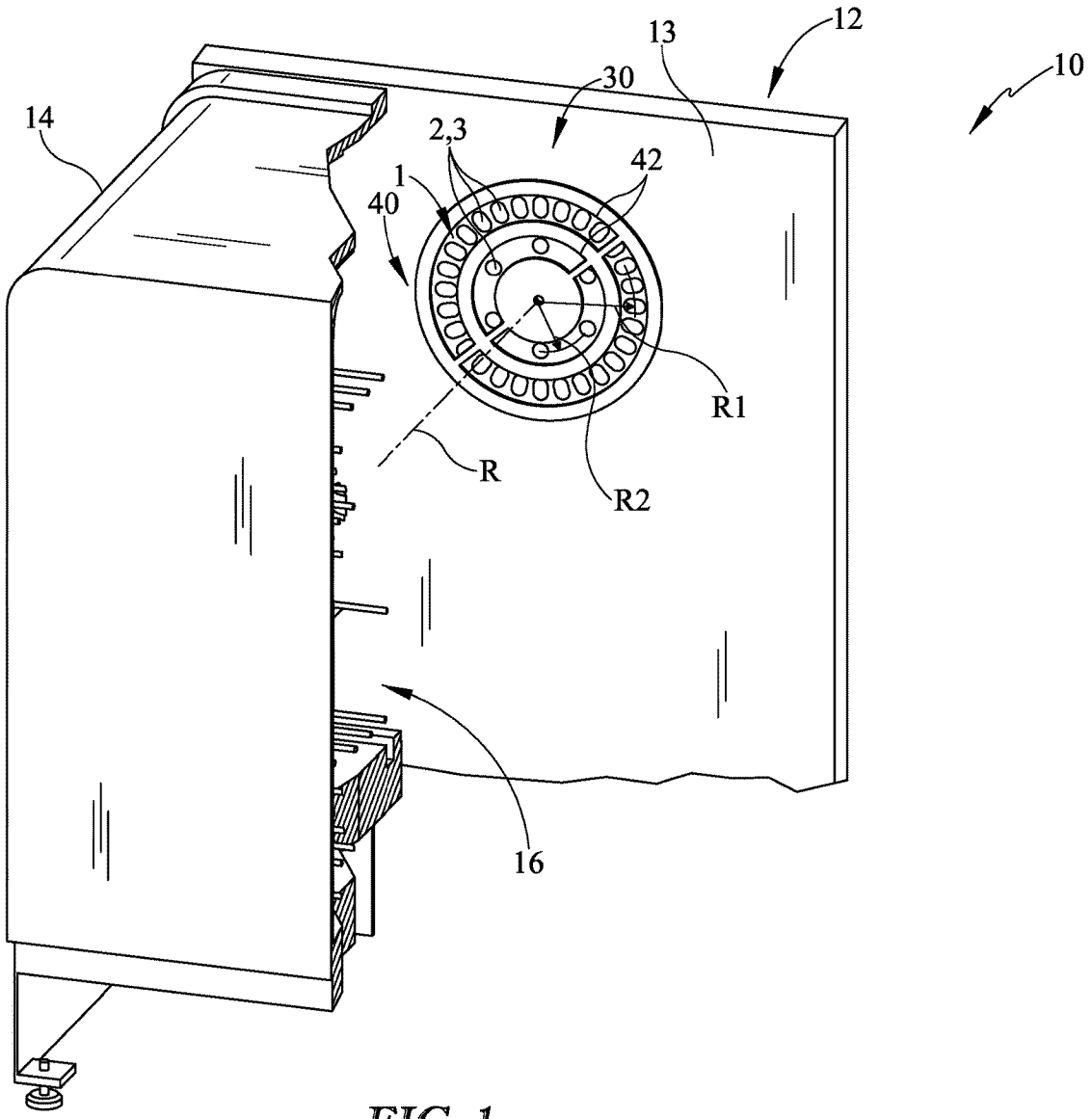
FIG. 1 is a partial perspective interior view of a dishwasher consistent with some embodiments of the invention illustrating an example detergent dispenser within an interior of dishwasher door.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position (not shown) and a closed position illustrated in FIG. 1. When door 12 is in the opened position, access is provided to one or more sliding racks, e.g., lower rack and upper rack, within which various utensils are placed for washing. The lower rack may be supported on rollers, while upper rack may be supported on side rails, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle. Additionally, dishwasher 10 may include one or more rotating spray arms, e.g., lower spray arms, upper spray arm, or other sprayers, including various combinations of wall-mounted sprayers, rack-mounted sprayers, oscillating sprayers, fixed sprayers, rotating sprayers, focused sprayers, etc. However, this positioning is not intended to be limiting, as various sprayers may be positioned through the dishwasher.

In addition, consistent with some embodiments of the invention, dishwasher 10 may include a detergent dispenser 30 with multiple dishwashing cycles' worth of detergent 2 within the dispenser 30, so that it is not necessary for a user to add additional detergent before each dishwashing cycle. Such a detergent dispenser 30 may be positioned, as illustrated in FIG. 1, on an interior 13 of the door 12. However, this positioning is not intended to be limiting, and in some embodiments the detergent dispenser may be positioned in other locations within the dishwasher (e.g. interior walls of wash tub 16) and still dispense detergent into the wash tub.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Numerous variations and modifications to the dishwasher 10 illustrated in FIGS. 1-13 will be apparent to one of ordinary skill in the art, as will become apparent from the description below. Therefore, the invention is not limited to the specific implementations discussed herein.

Now turning to the Figures, which illustrate an example detergent dispenser 30 in which the various technologies and techniques described herein may be implemented. In some embodiments, the detergent dispenser 30 may include one or more rotating members 20, 120, 220 to dispense one or more detergents 2 into the wash tub 16. The rotating members 20, 120, 220 rotate about at least one rotational axis R to one or more rotational positions to orientate the one or more rotating members 20 proximate the detergent 2/compartment 3 or outlet 42 to expel the detergent from a blister pack 1. The rotating members 20 may follow one or more paths to a variety of rotational positions and/or radial positions about the rotational axis R, and engage detergents other than in an arcuate or circumferential pattern within the blister pack 1 as shown in the embodiments. At least one rotating member 20 may engage a plurality of detergents 2 along a radial distance from the rotational axis or engage a plurality of detergents along a plurality of radial distances from the rotational axis.

In some implementations, the rotating or moveable members 20 or portions thereof may engage/disengage from the blister 3 and/or expel detergent 2 from the blister pack 1 via rotational movement (e.g. clockwise and/or counterclockwise), axial movement (e.g. parallel movement to the rotational axis away from or towards the blister pack), linear/radial movement away from or towards the rotational axis, or a combination thereof in one or more sequences or washing cycles. For example, as shown in the embodiments in FIGS. 1-4, the one or more rotating members 20 may engage/disengage from a blister compartment 3/detergent 2 along the same circumferential path (e.g. at a constant radial length from the rotational axis R), without axial movement in the direction along the rotational axis R. For example, the rotational movement of the rotating member 20 may be in a first rotational direction (e.g. clockwise), a second rotational direction (e.g. counter clockwise or different from the first rotational direction), or both. In the embodiment shown in FIGS. 5-8, the one or more rotating members 120 or portions thereof may extend radially away from and/or towards the rotational axis R to engage/disengage from the one or more detergents 2 or compartments 3. In addition, in the embodiment shown in FIGS. 9-12, the one or more rotating members 220 or portions thereof may extend axially along the rotational axis R towards and/or away from the blister pack 1 and/or motor 72 to dispense the detergent 2 when in the one or more rotational positions. It should be understood, the rotating member 20 may be a variety of shapes, sizes, quantities, and constructions and still expel/dispense the one or more detergents 2 from the blister pack 1 or compartment 3 in one or more rotational positions towards the wash tub 16.

In some embodiments, the detergent dispenser 30 may include one or more blister packs 1. In various embodiments, the one or more detergents 2 may be positioned by one or more blister packs 1. Each blister pack 1 may be configured to hold one or more detergents 2; this includes detergent of all varieties, including, but not limited to, liquid detergent, rinse aids, powder detergent, and/or dissolvable pod or capsule detergent. As illustrated in Figures, the detergent may be a dissolvable dishwashing pod/capsule/tablet within a blister or compartment 3 of the detergent blister pack 1. One or more detergents 2 may be dispensed for a variety of wash cycles. Each blister pack 1 may include a plurality of unit doses. In the one blister pack 1 shown, the blister pack is a circular or wheel-like plate. The plurality of detergents 2 may be arranged about a rotational axis R. In some implementations of the blister pack, blisters and/or compartments 3 formed with the plastic material may be positioned along one or more circumferences or arcuate paths thereof may receive the tablets of detergent 2. For example, the compartments 3 or detergents 2 at the larger radius/circumference R1 may be the tablet detergent and the compartments 3 at the smaller radius/circumference R2, if used, may be the rinse-aid tablets. The compartments 3 filled with tablets/detergents 2 may be covered by a foil or material. For ejection of the detergents 2 for the compartments during operation, weakening lines or the like may be provided for around or within each single compartment 3. Moreover, a blade 60, if used, may be used in various embodiments to aid in the tearing/ejection of the blister or package. For example, as shown in the embodiments in FIG. 5-13, a backing plate 140 may include one or more blades 60 adjacent one or more outlets 42 therein. In some implementations as in the embodiments shown, the blister pack 1 may be stationary relative to one or more portions of the dispenser 30 (e.g. motor, rotating members, backing plate, etc.). Alternatively, in some embodiments not shown, the blister pack may not be stationary (e.g. move or rotate). It should be understood that the blister pack 1 and/or portions thereof may be a variety of quantities, shapes, sizes, patterns of compartments/detergents, and constructions and still be within the scope of the invention.

In some embodiments, the detergent dispenser 30 may include one or more backing plates 40, 140. The backing plate, if used, may support the blister pack 1 or compartments 3 of the blister pack 1 (e.g. when the detergent/blister is engaged/disengaged by the rotating members 20, 120, 220) under compression. The backing plate 40, 140 may be positioned on or adjacent to at least one side of the blister pack 1. The other side of the backing plate 40, 140 may include the rotating members 20, 120, 220. The backing plate 40, 140 may include one or more outlets 42 in communication with or upstream from the wash tub 16. The outlets 42 of the backing plate are proximate the detergent/compartment 2, 3 and/or the plurality of rotational positions or the rotating members. One embodiment of the outlet 42 in FIGS. 1-4 are arcuate in shape. Another embodiment shown in FIGS. 5-13 illustrate circular through holes or outlets 42. The backing plate 40 may be stationary or fixed as shown in the one embodiment in FIGS. 1-4. In some implementations, as shown in FIGS. 5-13, the backing plate 140 and/or outlets 42 may rotate about the rotational axis R (e.g. motor 72 or shaft 73) between a plurality of rotational positions to be proximate or expel the detergent 2 and/or compartment 3. The backing plate 140, if rotatable, may engage the shaft 73 or motor 72 and rotate with the motor shaft 73 between the rotational positions to position the one or more outlets 42 proximate or in communication with the elongated and/or rotating members 20, 120, 220 (e.g. second end, roller, or actuator) in the rotational positions. For example, one outlet 42 may be at a larger radius R1 proximate a plurality of detergents at the larger radius R1 of the blister pack and another outlet 42 may be at smaller radius R2 proximate a plurality of detergents 2 at a smaller radius R2 of the blister pack 1. In embodiments that the backing plate 140 or portions thereof rotate about the rotational axis R, the backing plate may rotate in one or more rotational directions. If the backing plate is fixed, as shown in the one embodiment in FIGS. 1-4, the plurality of outlets 42 may be positioned proximate each detergent 2 or compartment 3 of the blister pack 1 to receive of be in communication therewith. In some embodiments, the dishwasher 10 may spray water or other liquid into the one or more outlets 42 in order to wash the detergent from the detergent dispenser or backing plate. It should be understood that the backing plate and/or outlets may be a variety of shapes, sizes, quantities, and constructions and still be within the scope of the invention.

Figure 4:
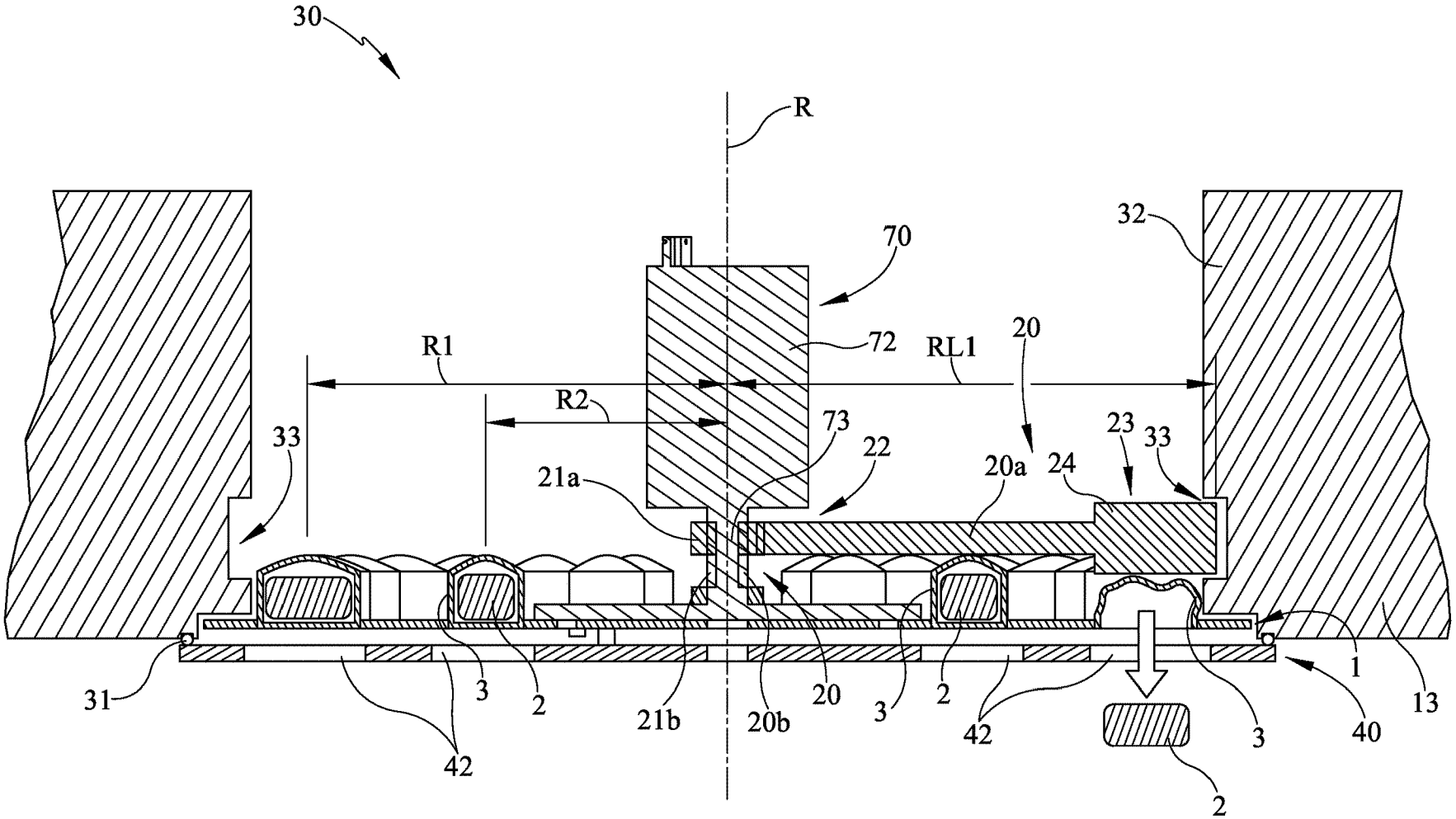
FIG. 4 is a sectional view taken along line 4-4 of FIG. 2 within a housing of the dishwasher door.
Figure 5:
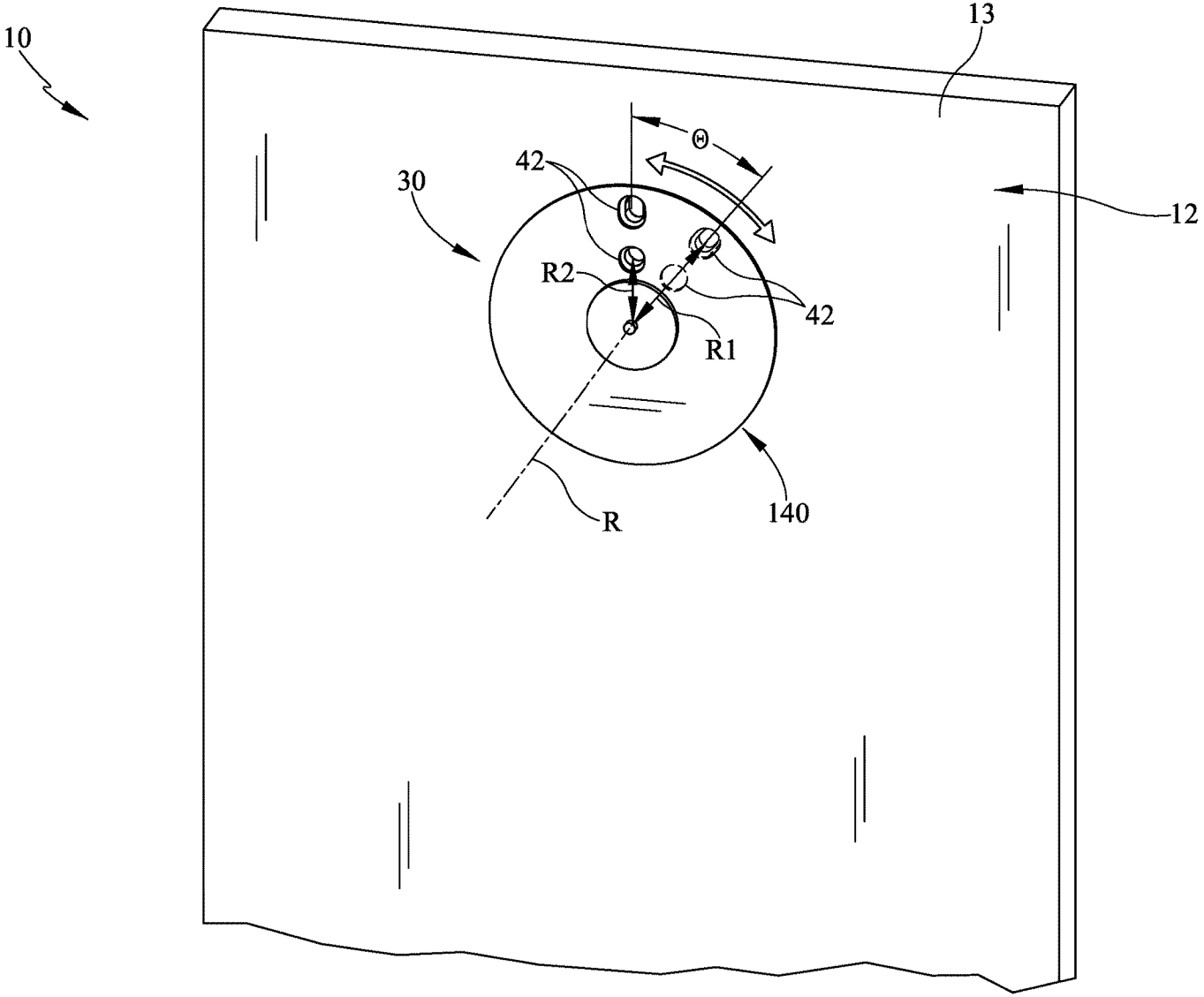
FIG. 5 is a perspective view of a dishwasher door with another embodiment of a detergent dispenser.

Shown in one embodiment in FIG. 4, the detergent dispenser 30 or backing plate 40, 140 may additionally include a seal or compression seal 31 designed to minimize or prevent entry of water or other liquid into the detergent dispenser. In some instances, these seals may utilize compression forces in order to seal the backing plate 40, 140 or housing 32. For example, the seal 31 may be positioned between the backing plate and the door 12 or interior 13.

Figure 2:
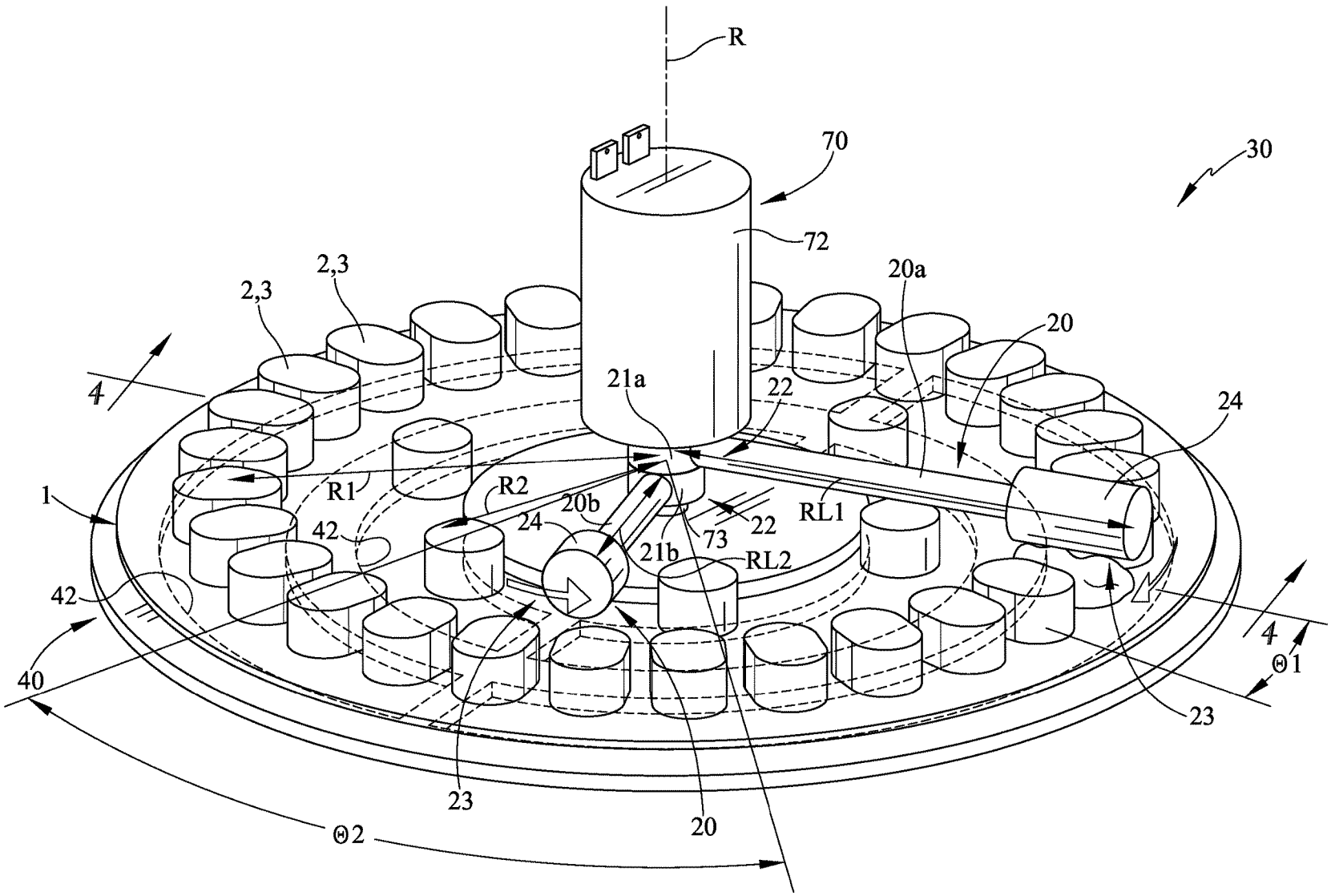
FIG. 2 is a perspective view of the detergent dispenser of FIG. 1 illustrating the outlets of the backing plate in broken lines and a first rotating member in a first rotational position engaging/dispensing a blister/detergent at a larger radius and a second rotating member in a second rotational position disengaged from a blister/detergent at a smaller radius.

In some implementations, the detergent dispenser 30 may include one or more rotating members or arms 20, 120, 220 and/or backing plates 140 rotating about at least one rotational axis R between a plurality of rotational positions to dispense detergent 2 towards the wash tub 16. The rotational positions of the backing plate and/or rotating members, proximate the one or more detergents 2 and/or outlets 42 to dispense the detergents from the blister pack, may be a variety of rotational positions or degrees θ between positions. Moreover, the rotational positions may be between or spaced from detergents and therefore do not have to be proximate the detergents 2 or blisters 3 in each rotational position. The one or more rotating members and/or backing plate may rotate in the same or different rotational directions/positions and/or degrees of rotation. The spacing or degrees between rotational positons of one or more rotational members and/or backing plates may be the same, but may be different in some embodiments. For example, as shown in FIG. 2, the longer or first rotating member 20*a* engages adjacent detergents at adjacent rotational positions at a degree θ1 that is smaller than the degree θ2 between the smaller or second rotating member 20*b*. The degrees or spacing between the rotational positions of two rotating members may be the same in some embodiments. Moreover, two or more rotating members and/or backing plate may rotate together or rotate independently from each other to a variety of rotational positions. It should be understood that the rotating members may be a variety of constructions, shapes, sizes, and quantities and still be within the scope of the invention.

As illustrated in the Figures, the detergent dispenser 30 may include one or more drive mechanisms 70. The one or more drive mechanisms 70 may rotate the rotating members 20, 120, 220 and/or backing plate 140, or other portions of the detergent dispenser. One embodiment of the drive mechanism may be a motor 72 (e.g. a DC motor) with a shaft 73 that may rotate at least one of the one or more rotating members and/or backing plate in multiple rotational positions and/or directions, so that at any point during the rotation at least one of the outlet, roller, actuator, and/or portion of the rotating arm may be positioned near one of the detergents.

Figure 3:
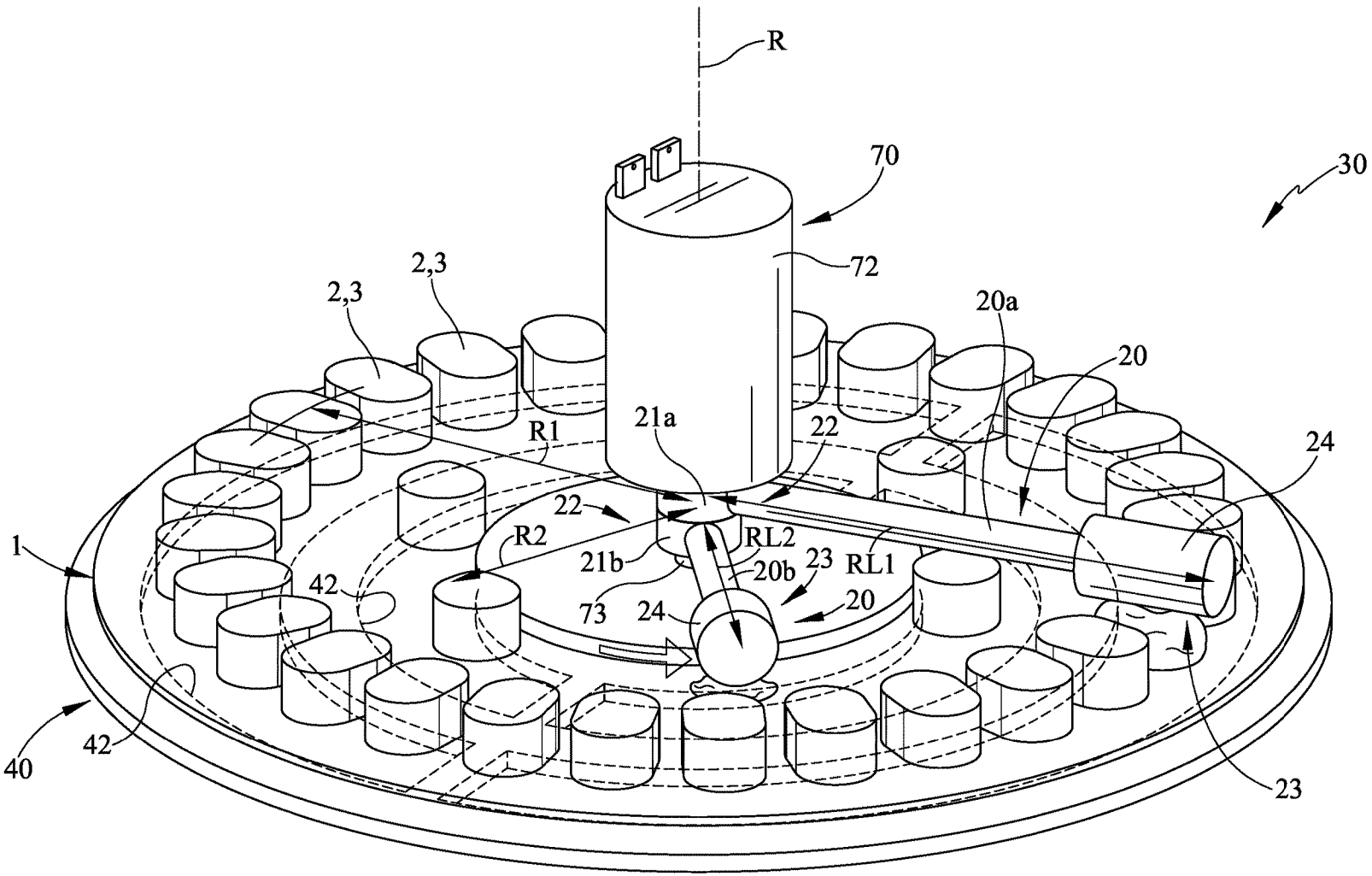
FIG. 3 is a perspective view of the detergent dispenser of FIG. 2 illustrating the first rotating member in the first rotational position having dispensed the detergent and the second rotating member in another rotational position engaging the blister/detergent at the smaller radius.

The motor 72 may include the shaft 73 extended along the rotational axis R. The shaft 73 may rotate in one or more rotational directions. The rotating shaft 73 may define the rotational axis R. The shaft 73 may engage one or more portions of the detergent dispenser 30 (e.g. one or more rotating arms, backing plate, actuators, rollers, etc.). As shown in the Figures, the motor 72 may rotate the one or more rotating members 20, 120, 220 between multiple rotational positions and/or directions. Moreover, in some embodiments, the one or more rotating members 20 or detergent dispenser 30 may include one or more one-way bearings 21*a*, 21*b*. The one way bearing, if used, allows the motor 72/shaft 73 to turn one or more portions of the detergent dispenser in single rotational direction, but not the other rotational direction when the shaft 73 reverses or changes rotational direction. For example, as shown in FIGS. 2-4, if the first rotating member 20*a* includes a one-way bearing 21*a* engaging the shaft 73, the first rotating member 20*a* may only rotate in the clockwise or first rotational direction to a first plurality of rotational positions, and not the counterclockwise direction. In addition, if the second rotating member 20*b*, is used, and includes a one-way bearing 21*b* engaging the shaft 73, the second rotating member 20*b* may only rotate the counterclockwise or second rotational direction to a second plurality of rotational positions, and not the clockwise direction of the shaft. In various embodiments, the one or more motors may rotate at least the backing plate, the one or more rotating members, or both between multiple rotational positions and/or directions.

In other embodiments not shown, the drive mechanism 70 may be a user-pretensioned spring (e.g. a clock spring) that may allow energy to be provided by a user and then be stored and used in order to change the rotational positions of one or more portions of the detergent dispenser. In such an embodiment, a user may "wind up" the pretensioned spring. A solenoid may then push a pawl in order to release a ratcheted segment to eject at least one detergent and/or rotate one or more portions of the detergent dispenser (e.g. rotating members and/or backing plate.

Figure 10:
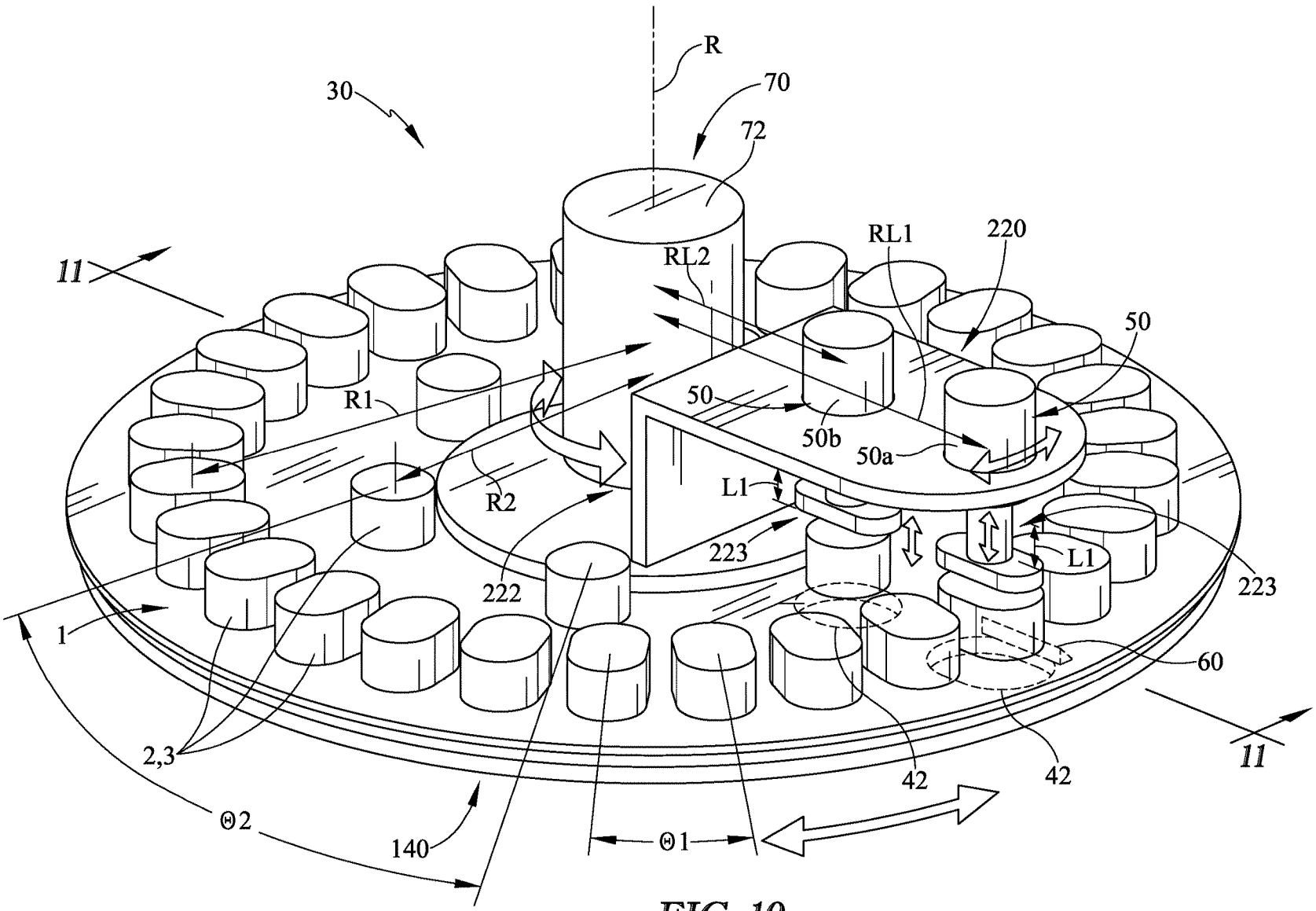
FIG. 10 is a perspective view of the detergent dispenser of FIG. 9 illustrating the outlets of the backing plate in broken lines in a first rotational position and a rotating member or portions thereof having a first length in a first rotational position disengaged from a blister/detergent at a first radius and a second radius, wherein the second radius is smaller than the first radius.
Figure 11:
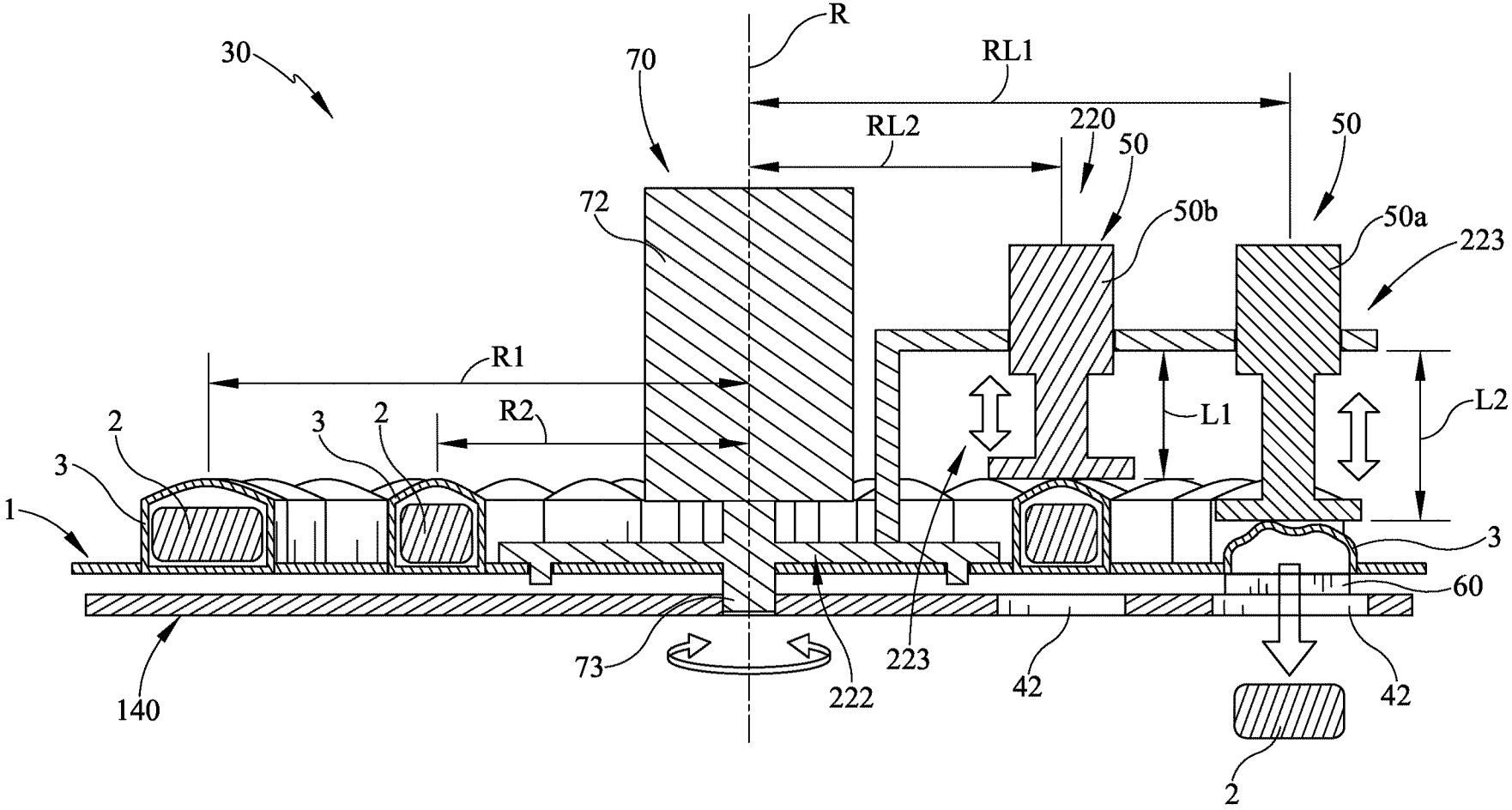
FIG. 11 is a sectional view taken along line 11-11 of FIG. 10 illustrating a portion of the rotating member in a second length, larger than the first length, in the first rotational position engaging/dispensing a blister/detergent at the first radius.
Figure 12:
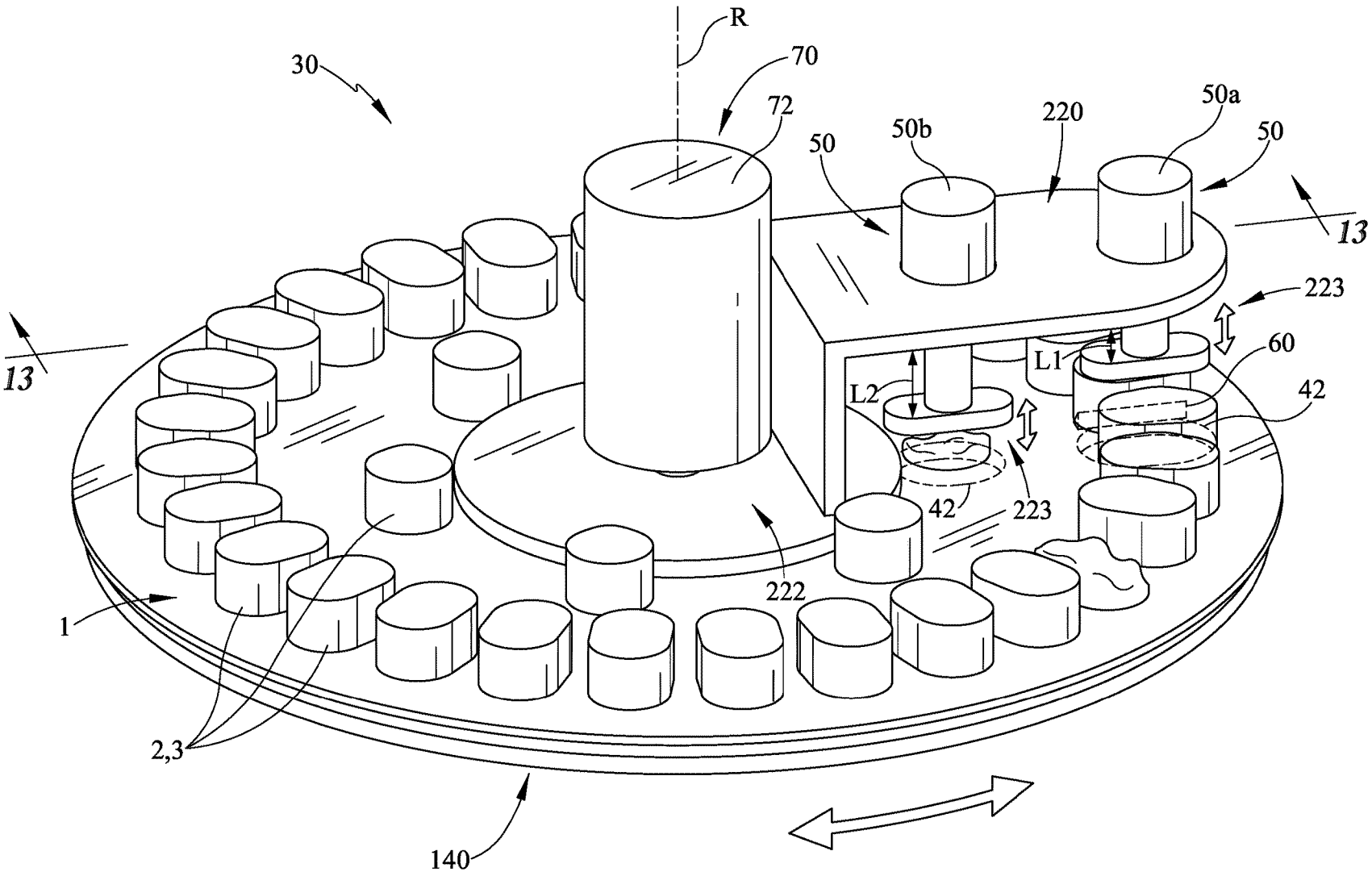
FIG. 12 is a perspective view of the detergent dispenser of FIG. 9 illustrating the outlets of the backing plate in broken lines and in another rotational position and a portion of the rotating member having a second length in another or second rotational position engaging/dispensing a blister/detergent at the second radius and another portion of the rotating member having the first length disengaged from a blister/detergent at the first radius, wherein the second radius is smaller than the first radius.
Figure 13:
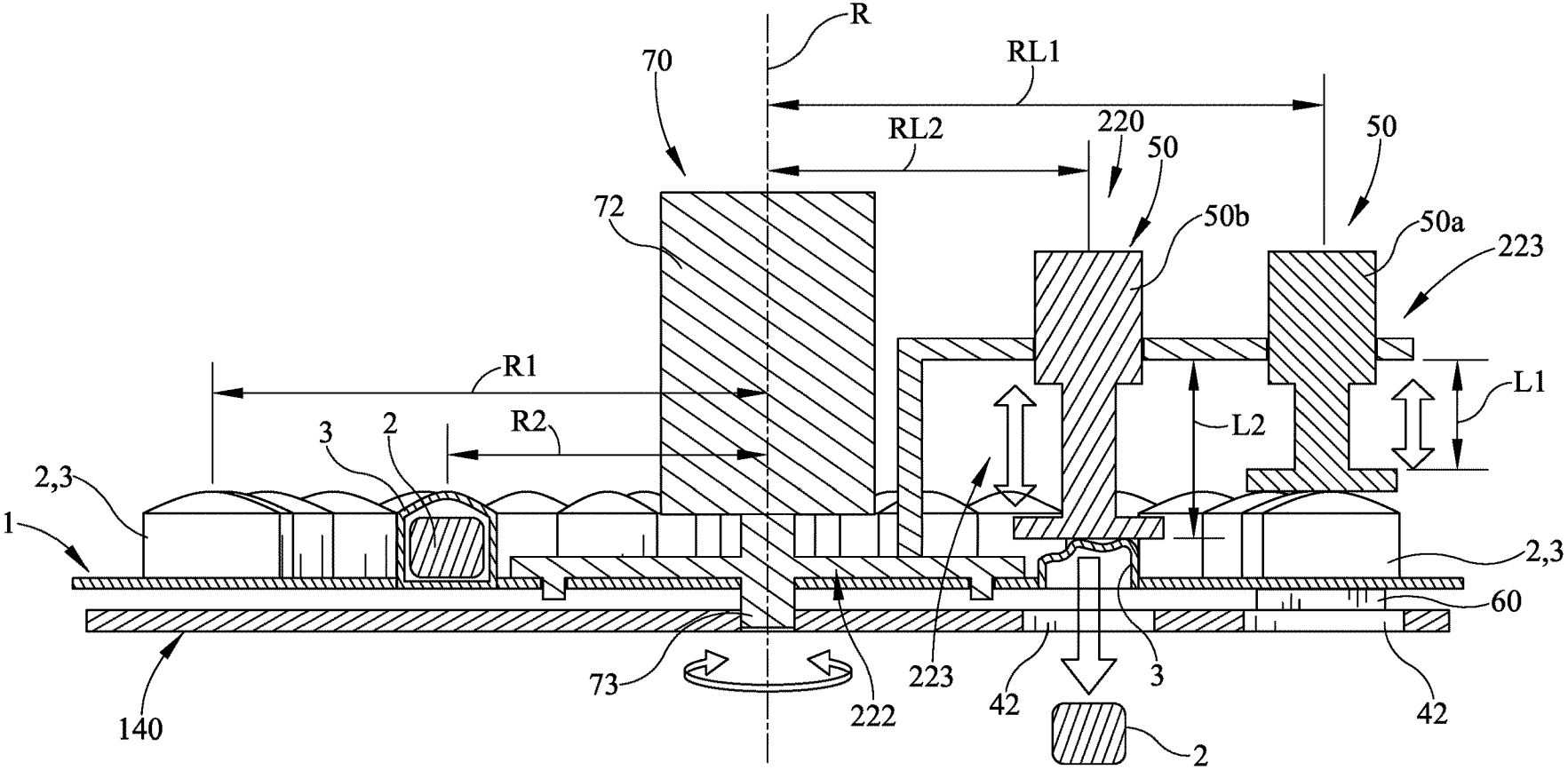
FIG. 13 is a sectional view taken along line 13-13 of FIG. 12.

In some implementations, the detergent dispenser 30 may include one or more actuators 50 to variably control at least a portion of the ejection mechanism (e.g. one or more rotating members, backing plate, etc.). The rotating member 20, 120, 220 may include one or more of the actuators 50 for one or more applications. One example of the actuator 50 may be a solenoid (e.g. electric, linear, etc.). The one or more actuators 50 may control the variable length (e.g. radial and/or axial) of one or more rotating members 120, 220 to expel the detergent 2. In some embodiments not shown, for example, one dispenser 30 may have the length of one rotating member be fixed in length and/or another rotating member may have a variable length/position or actuator. In some embodiments, as shown in FIGS. 5-13, the one or more actuators 50 may be rotated by the motor 72 or drive mechanism 70. The one or more rotating members 120 and 220 (see FIGS. 6 and 10) may include the one or more actuators. The actuators 50 and/or rotating members 120, 220 may be rotated to the plurality of rotational positions to dispense the detergent 2 for a cycle of the appliance/wash tub. As shown in FIGS. 5-8, the one or more actuators 50 may vary the radial length of the rotating member 120 away from or towards the rotational axis R (e.g. lengthen and/or shorten). The one or more actuators 50 may extend the rotating member or second end 123 between a first radial length RL1 and a second radial length RL2. For example, the first radial length RL1 may be larger to engage a larger circumference or radius R1 of detergents 2 of the blister pack than the second radial length RL2 to engage a smaller circumference or radius R2 of detergents 2 of the blister pack 1. In various embodiments, as shown in FIGS. 9-13, one or more actuators 50, if used, may extend a portion or second end 223 of the rotating member 220 axially or parallel to the rotational axis R. The lengthening or shortening in the axial direction parallel (e.g. not perpendicular) to the rotational axis may be towards and/or away from the blister pack 1 between a first length L1 and a second length L2. When in at least one rotational position as shown in FIGS. 10-13, the distal/second end 223 or one or more portions of the rotational member may be positioned in the first length L1 and may be disengaged from the detergent and/or compartment. When in the second length L2 as shown in FIGS. 11-13, the rotating member 220 or one or more portions thereof may be larger or longer than the first length L1 and supply force to the individual detergent 2 and/or compartment 3 to dispense the detergent 2 out of the blister pack 1 and towards backing plate outlet 42 or wash tub 16. In other embodiments not shown, a rotating member may include one or more actuators to extend/deploy the elongated members both radially and axially in length to dispense or eject the detergent.

Figure 6:
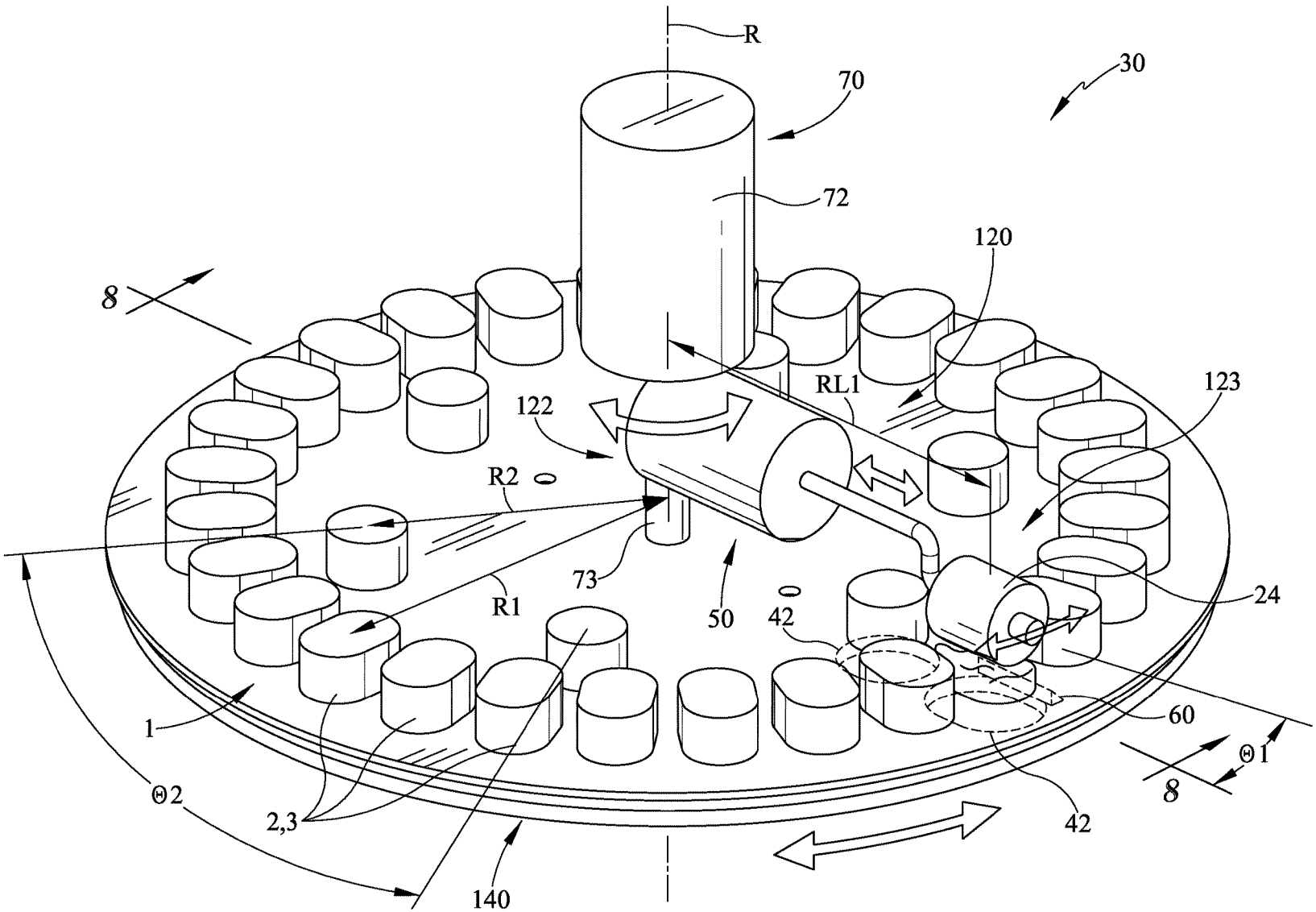
FIG. 6 is a perspective view of the detergent dispenser of FIG. 5 illustrating portions of the outlets of the backing plate in broken lines in a first rotational position and a rotating member having a first radial length in a first rotational position engaging/dispensing a blister/detergent at a first radius.
Figure 7:
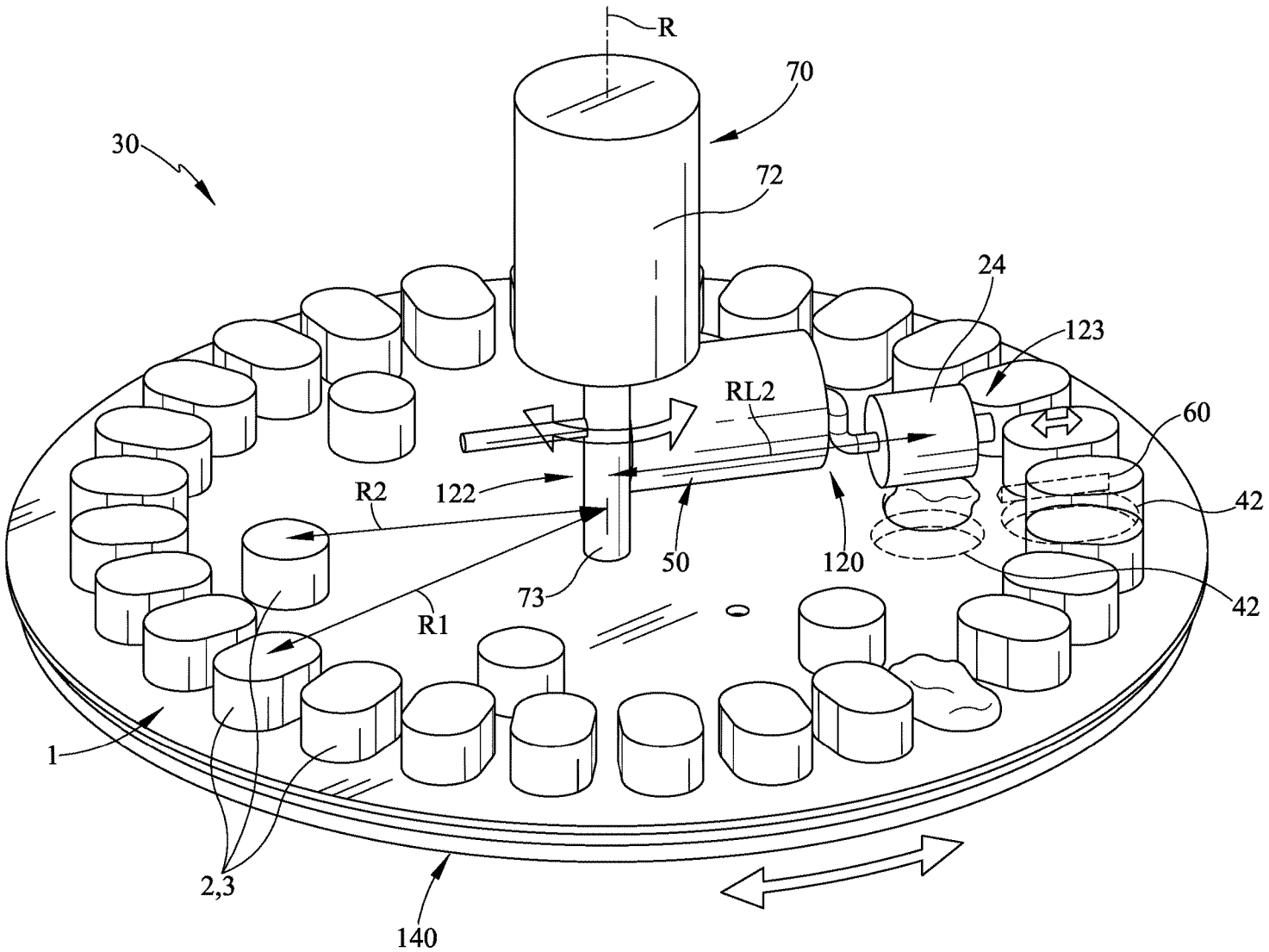
FIG. 7 is a perspective view of the detergent dispenser of FIG. 5 illustrating the outlets of the backing plate in broken lines in a second rotational position and the rotating member in a second radial length, smaller than the first radial length, in a second rotational position engaging/dispensing a blister/detergent at a second radius, smaller than the first radius.
Figure 8:
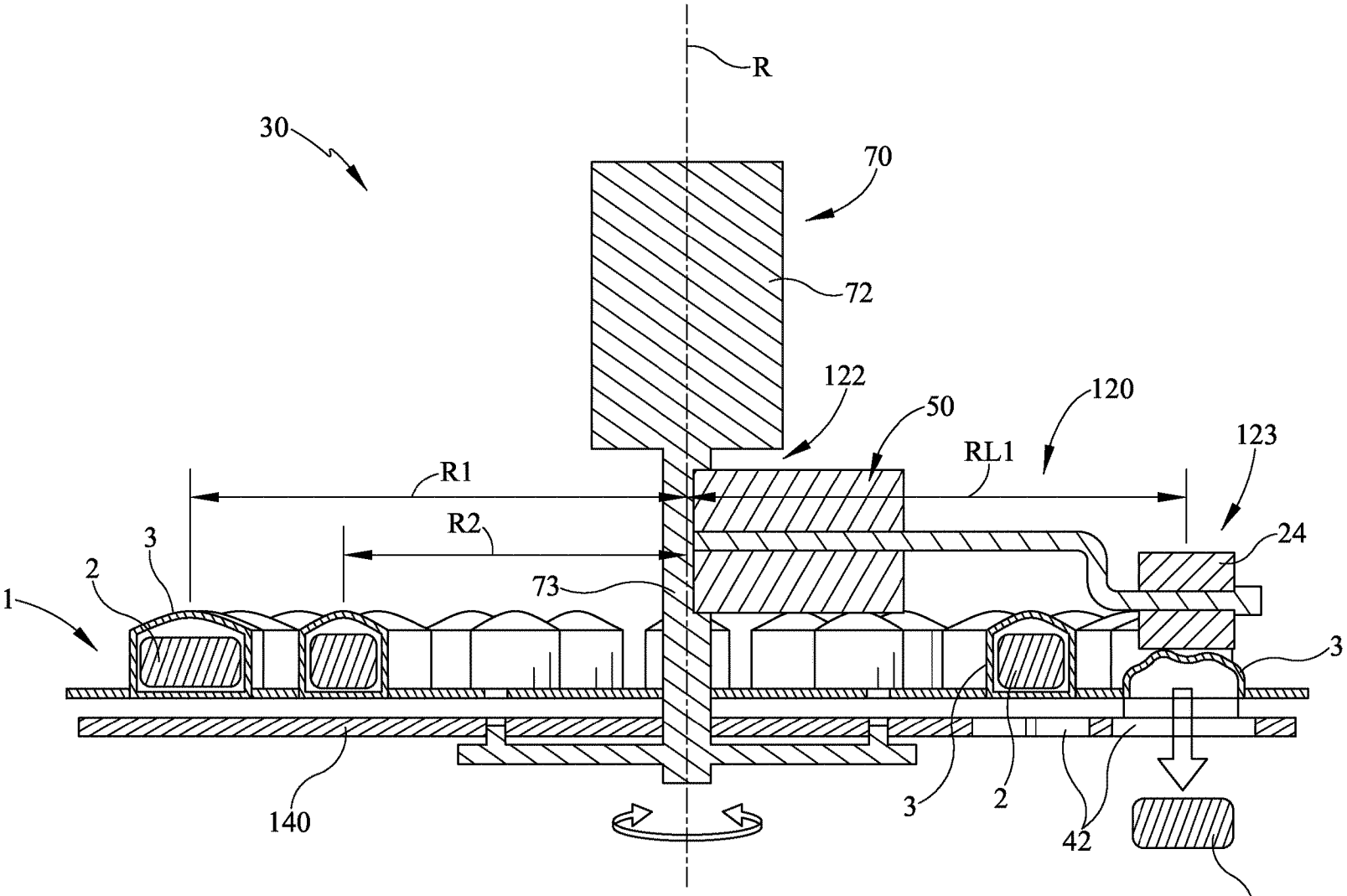
FIG. 8 is a sectional view taken along line 8-8 of FIG. 6.
Figure 9:
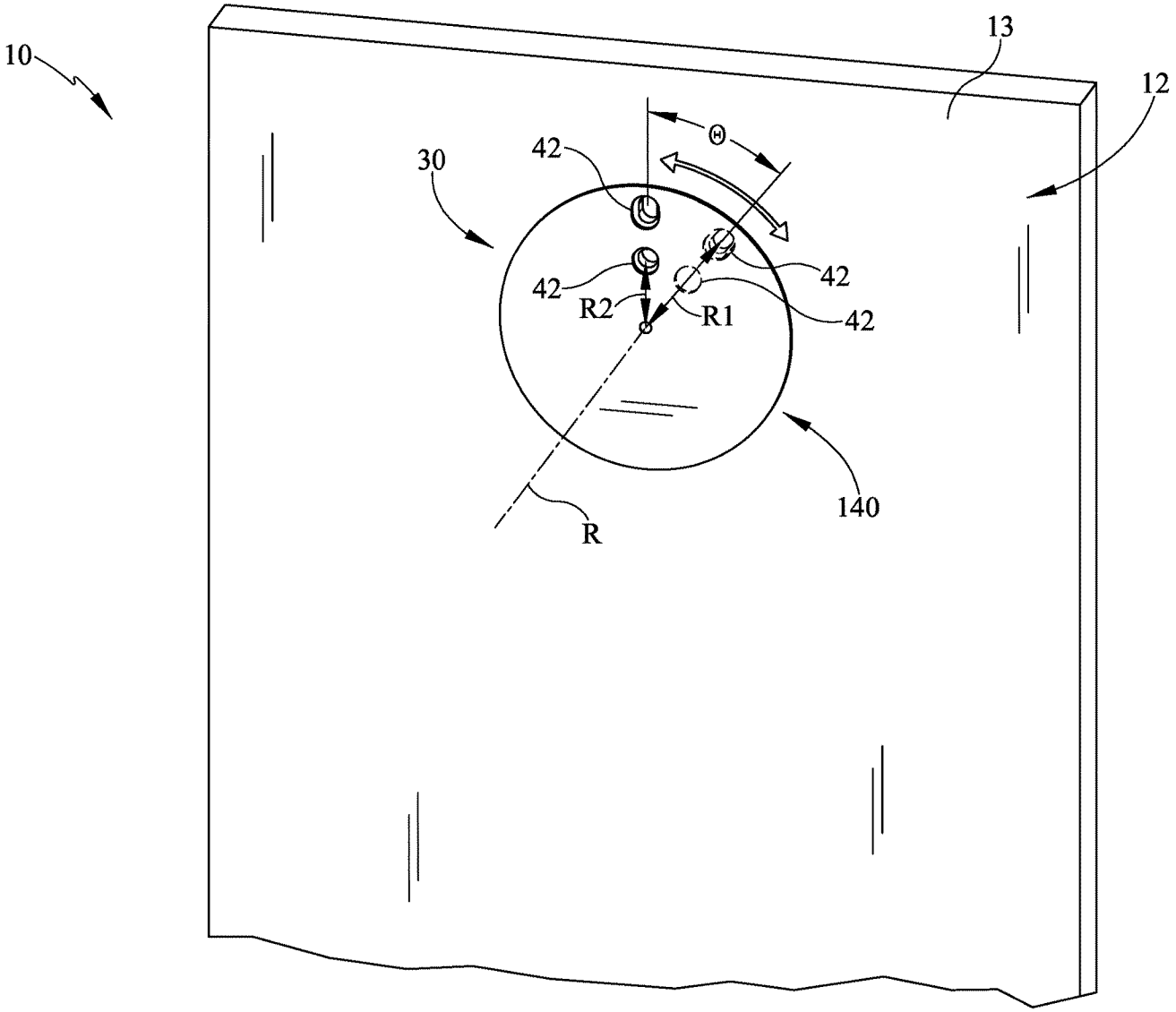
FIG. 9 is a perspective view of a dishwasher door with another embodiment of a detergent dispenser.

The rotating members may be a variety of constructions, quantities, shapes, and sizes and still rotate or eject the detergent from the blister pack. As shown in the figures, one embodiment of the rotating members 20, 120, 220 may be elongated with opposing ends. One or a first end 22, 122, 222 may be adjacent to and may engage the shaft 73 and the other or second end 23, 123, 223 may extend or project radially outward from the shaft 73 or rotational axis R. When the shaft 73 rotates, the second end 23, 123, 223 may rotate about the shaft or first end 22, 122, 222 of the member between the plurality of rotational positions or directions. The second end or portions 23, 123, 223 of the rotating member may include the one or more rollers 24 and/or one or more actuators 50, if used. The actuators 50 at the second end 223 of the rotating members may be spaced (e.g. radially) from each other along the rotating member or plate to engage and expel detergents 2 at multiple radial distances from the rotational axis R. The actuators 50 at the second end 223 may vary the axial length at the same or different times at their respective radial distances from the rotational axis. For example, as shown in FIGS. 10-12, a first actuator 50*a* may be positioned at a first radial distance or radius R1 from the rotational axis R and the second actuator 50*b* may be positioned at a second radial distance or radius R2 less than the first radial distance R1. In various embodiments as shown in FIGS. 6-8, the first end 122 or portions (e.g. second end) of the rotating member 120 may include the one or more actuators 50 to vary the radial length RL1, RL2. As shown in FIG. 4, the second end 23 or portion of the rotating member 20 may engage a track engagement 33 (e.g. annular groove, circumferential slot of the dishwasher 10, housing, or interior 13) to minimize deflection of the rotating member 20 when dispensing/pushing/ejecting the detergent.

In some embodiments as shown in FIGS. 2-4 and 6-8, the rotating members 20, 120 may include one or more rollers 24. The roller 24, if used, may contact the compartment 3 and/or detergent 2 to dispense the detergent 2 towards the backing plate 40, 140 or wash tub 16. The roller 24 may be cylindrical in shape. The cylindrical axis of the roller 24 may be transverse (e.g. perpendicular) to the rotational axis R of the motor shaft 73. Moreover, the roller 24 may rotate independently of the remaining portion of the rotating member or arm. Alternatively, in some embodiments the roller 24 may be stationary or fixed relative to the remaining portion of the rotating member. The second end or portions of the rotating member may include one or more rollers 24, if used.

In some implementations, a housing 32 (e.g. compartment and/or lid) within the wash tub 16 may (removably or fixedly) receive the detergent dispenser 30. In some embodiments, the housing 32 may be a separate component of the detergent dispenser 30 separable from the dishwasher 10; while in other embodiments, the housing 32 may be incorporated (e.g. by molding or the like) directly into the door 12 of the dishwasher 10. The housing (e.g. a lid or cover dispose over the backing plate or dispenser) may additionally include a dispensing outlet or ejection window configured to guide or direct the detergent contained in each detergent blister pack to the proper location within the wash tub when dispensed from the backing plate.

In some embodiments, the detergent dispenser or portions thereof may be removable from the housing 32 or dishwasher door 12 so that a user may load another detergent blister pack 1 or clean the detergent dispenser. The backing plate 40, 140 and/or a cover (not shown) of the housing 32 with ejection window disposed over the backing plate or dispenser may be opened and a new or unused detergent blister pack may be installed and cover and/or backing plate subsequently closed with the dishwasher door.

In the one embodiment shown in FIGS. 1-4, the detergent dispenser 30 illustrates one or more rotating members 20 having a fixed radial length RL1, RL2. The detergent dispenser includes a stationary blister pack 1 and backing plate 40 with a plurality of outlets 42. The motor shaft 73 may drive the first rotating member 20*a* and the second rotating member 20*b*, different from the first rotating member, in a variety of rotational positions on one side of the blister pack 1. The first rotating member 20*a* has a fixed radial length RL1 that is longer than the fixed radial length RL2 of the second rotating member 20*b*. The motor 72/shaft 73 rotates the first rotating member 20*a* to engage the blister pack or detergents at the first radial distance or radius R1 from the shaft 73. Moreover, the motor 72/shaft 73 rotates the second rotating member 20*b* to engage the blister pack or detergents at the second radial distance or radius R2 from the shaft 73. The second radial distance R2 is shorter than the first radial distance R2. The bearings 21*a*, 21*b*, if used, may control the motion or direction of the one or more rotating members or arms. Each of the first rotating member 20*a* and the second rotating member 20*b* includes a one-way bearing 21*a*, 21*b* respectively, such that the first rotational direction (e.g. clockwise) of the motor/shaft rotates only the first rotational member and the other or second rotational direction (e.g. counterclockwise) of the motor/shaft rotates only the second rotating member. The first end 22 of each rotating member 20*a*, 20*b* may be adjacent the shaft 73 and the second end 23 with rollers 24, if used, are adjacent the radial distance R1, R2 to engage the detergent or blister pack compartment. With the blister pack 1 and backing plate 40 being stationary in this one embodiment, the first and/or second rotating members 20*a*, 20*b* dispense the detergent(s) at the one or more rotational positions from the blister pack 1 through the one or more outlets 42 of the backing plate 40 toward the wash tub. Moreover, for example, the first and/or second rotating member 20*a*, 20*b*, may include one or more actuators in some embodiments. Also, although not shown, the backing plate 40 may rotate in some embodiments.

In the one embodiment shown in FIGS. 5-8, the detergent dispenser 30 illustrates at least one rotating member 120 having at least one actuator 50 varying the radial length of the rotating member 120 allowing chemical or detergent selection. The actuator 50 may linearly extend a portion of the rotating member/arm 120 or second end 123 between one or more radial lengths (e.g. RL1, RL2, RL3, etc.) to engage/disengage the second end 123 or roller 24, if used, with the compartment 3 or detergent 2. The motor 72/shaft 73 rotates the rotating member 120, actuator 50, and/or backing plate 140 between the plurality of rotational positions proximate the detergent at one or more radial positions. The actuator 50, backing plate 140, and rotating member 120 may rotate with the shaft 73 in one or more rotational directions. It should be understood that the rotating member 120 may include additional actuators (e.g. to extend the axial length of the rotating member) and/or additional rotating arms with actuators or fixed length.

In the one embodiment shown in FIGS. 9-13, the detergent dispenser 30 includes one or more rotating members 220 having at least one actuator 50 varying the axial length (e.g. L1, L2, L3, etc. substantially parallel to the rotational axis) of the rotating member or portions thereof to dispense the detergent 2 from the blister pack 1. The blister pack 1 may be stationary with the rotating member(s) and rotating backing plate 140 disposed on opposing sides thereof. At least one rotating member 220 includes the first actuator 50*a* and the second actuator 50*b* proximate the second end 223 thereof. The first/second actuator 50*a*, 50*b* extends at least a portion of the rotating member 220 or second end 223 in the direction parallel to the rotational axis R to engage/disengage from the blister pack or compartments 3 between the first length L1 and the second length L2. The second length L2 may be larger to engage/expel the detergent 2 and the first length L1 may be smaller to disengage from the detergent and/or allow rotation of the rotating member/actuator. The first actuator 50*a* may be positioned on the rotating member at the first radial distance R1 larger than the second actuator 50*b* at the second radial distance R2 to each engage detergents of the blister pack of different radial distances in one or more rotational positions. Therefore, the first actuator 50*a* engages detergents of the blister pack 1 at a larger radial distance R1 from the rotational axis R than second actuator 50*b*. Alternatively, the first and second actuators 50*a*, 50*b* may be positioned on separate rotating members in some embodiments. Alternatively, for example, the rotating member(s) 220 may include an actuator to vary the radial length RL1, RL2 of the rotating member in combination with the varying length actuator in various embodiments.

In some implementations, dishwasher 10 may be under the control of a controller that receives inputs from a number of components and drives a number of components in response thereto. Controller may for example, include one or more processors and a memory (not shown) within which may be stored program code for execution by the one or more processors. The memory may be embedded in controller, but may also be considered to include volatile and/or non-volatile memories, cache memories, flash memories, programmable read-only memories, read-only memories, etc., as well as memory storage physically located elsewhere from controller, e.g., in a mass storage device or on a remote computer interfaced with controller.

The controller may be interfaced with various components of the dishwasher 10, including an inlet valve that is coupled to a water source to introduce water into wash tub, which when combined with detergent, rinse agent and/or other additives, forms various wash fluids. Controller may also be coupled to a heater that heats fluids, a pump that recirculates wash fluid within the wash tub by pumping fluid to the wash arms and other spray devices in the dishwasher, an air supply that may provide a source of pressurized air for use in drying utensils in the dishwasher, a drain valve that is coupled to a drain to direct fluids out of the dishwasher, and a diverter that controls the routing of pumped fluid to different spray arms and/or other sprayers during a wash cycle.

The controller may also be coupled to the detergent dispenser 30 to trigger the dispensing of detergent into the wash tub at appropriate points during a wash cycle. More particularly, the controller may be coupled to the drive mechanism 70 (e.g. motor) of the detergent dispenser 30, which may include one or more micro switches or a stepper motor in order to control and/or determine the rotational positioning or direction of the various rotating members 20, 120, 220, actuators 50, and/or backing plate 40, 140 (discussed in greater detail herein). The actuators 50 may also be coupled to the controller to dispense and/or engage/disengage the rotating members or portions thereof (e.g. radially and/or axially, etc.). Additional sensors and actuators may also be used in some embodiments, including a temperature sensor to determine a wash fluid temperature, a door switch to determine when door 12 is latched, and a door lock to prevent the door from being opened during a wash cycle. If used, a break beam sensor or other suitable sensors may be used to detect tablet ejection from the detergent dispenser 30, backing plate, etc. The tablet or detergent 2 dispensed from the detergent blister pack may break the beam upon ejection. Moreover, controller may be coupled to a user interface including various input/output devices such as knobs, dials, sliders, switches, buttons, lights, textual and/or graphics displays, touch screen displays, speakers, image capture devices, microphones, etc. for receiving input from and communicating with a user. In some embodiments, controller may also be coupled to one or more network interfaces, e.g., for interfacing with external devices via wired and/or wireless networks such as Ethernet, Bluetooth, NFC, cellular and other suitable networks.

Moreover, in some embodiments, at least a portion of controller may be implemented externally from a dishwasher, e.g., within a mobile device, a cloud computing environment, etc., such that at least a portion of the functionality described herein is implemented within the portion of the controller that is externally implemented. In some embodiments, controller may operate under the control of an operating system and may execute or otherwise rely upon various computer software applications, components, programs, objects, modules, data structures, etc. In addition, controller may also incorporate hardware logic to implement some or all of the functionality disclosed herein. Further, in some embodiments, the sequences of operations performed by controller to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Although described herein with respect to a dishwasher, this is not intended to be limiting. The technology and techniques disclosed herein may be utilized in any household appliance that requires dispensing of a detergent, such as, for example a washing machine.

Various additional modifications may be made to the illustrated embodiments consistent with the invention. Therefore, the invention lies in the claims hereinafter appended.

The invention claimed is:

1. A dishwasher comprising:

a wash tub; and a detergent dispenser positioned in the wash tub to dispense detergent into the wash tub including a stationary circular blister pack having a plurality of detergents arranged about a rotational axis;

a backing plate adjacent one side of the circular blister pack and having one or more outlets in fluid communication with the wash tub;

one or more rotating members adjacent the other side of the circular blister pack, wherein the one or more rotating members rotate about the rotational axis;

one or more drive mechanisms rotating the one or more rotating members about the rotational axis between a plurality of rotational positions, and wherein one or more of the plurality of rotational positions orient the one or more rotating members adjacent at least one respective detergent of the plurality of detergents and at least one respective outlet of the one or more outlets to dispense the at least one respective detergent into the wash tub; and wherein the one or more rotating members further includes one or more actuators to vary a radial length of the one or more rotating members and/or vary an axial length of the one or more rotating members parallel to the rotational axis.

2. The dishwasher of claim 1 wherein the one or more rotating members includes one or more rollers rotated to the plurality of rotational positions to dispense the at least one respective detergent into the wash tub through the one or more outlets.

3. The dishwasher of claim 1 wherein the one or more rotating members includes the one or more actuators rotated to the plurality of rotational positions to dispense the at least one respective detergent into the wash tub through the one or more outlets.

4. The dishwasher of claim 3 wherein the one or more actuators extends the one or more rotating members between a first radial length and a second radial length, wherein the first radial length is larger than the second radial length.

5. The dishwasher of claim 3 wherein the one or more actuators extends at least a portion of the one or more rotating members in the direction parallel to the rotational axis towards the circular blister pack between a first length and a second length, wherein the second length is larger than the first length.

6. The dishwasher of claim 1 wherein the one or more rotating members includes a first rotating member and a second rotating member, wherein the first rotating member is longer than the second rotating member, wherein the first rotating member engages the respective detergent of the plurality of detergents at a first radial distance from the rotational axis and the second rotating member engages the respective detergent of the plurality of detergents at a second radial distance, and wherein the first radial distance is larger than the second radial distance.

7. The dishwasher of claim 1 wherein the one or more rotating members includes a first rotating member and a second rotating member, and the first rotating member rotates independently from the second rotating member.

8. The dishwasher of claim 1 wherein the backing plate rotates about the rotational axis.

9. The dishwasher of claim 1 wherein the backing plate includes a blade adjacent the one or more outlets.

10. The dishwasher of claim 1 wherein the one or more rotating members includes the one or more actuators to vary the radial length of the one or more rotating members.

11. The dishwasher of claim 1 wherein the one or more rotating members includes the one or more actuators to vary the axial length of the one or more rotating members parallel to the rotational axis.

12. A dishwasher comprising:

a wash tub; and a detergent dispenser positioned in the wash tub to dispense detergent into the wash tub including a motor with a rotating shaft defining a rotational axis;

a stationary circular blister pack having a plurality of detergents arranged about the rotational axis;

a backing plate adjacent one side of the circular blister pack and having one or more outlets in fluid communication with the wash tub;

one or more rotating members adjacent the other side of the circular blister pack, each one of the one or more rotating members has a first end engaging the shaft of the motor and a second end projecting radially outward therefrom, wherein the one or more rotating members rotate with the shaft about the rotational axis;

wherein the shaft of the motor rotates the second end of the one or more rotating members between a first plurality of rotational positions, and wherein one or more of the first plurality of rotational positions orients the one or more rotating members adjacent at least one respective detergent of the plurality of detergents and at least one respective outlet of the one or more outlets to dispense the at least one respective detergent into the wash tub; and wherein the one or more rotating members includes a first rotating member having one or more actuators adjacent the second end, wherein the one or more actuators extends at least a portion of the first rotating member in a direction parallel to the rotational axis towards the circular blister pack between a first length and a second length, wherein the second length is larger than the first length and when in the first length the first rotating member is disengaged from the at least one respective detergent and when in the second length the first rotating member engages the at least one respective detergent.

13. The dishwasher of claim 12 wherein the one or more rotating members includes the first rotating member with a roller adjacent the second end.

14. The dishwasher of claim 13 wherein the one or more rotating members includes a second rotating member with a roller adjacent the second end.

15. The dishwasher of claim 14 wherein a radial length of the second rotating member is shorter than a radial length of the first rotating member.

16. The dishwasher of claim 15 wherein each of the first rotating member and the second rotating member includes a one-way bearing engaging the shaft, wherein the first rotating member rotates only in a first rotational direction and the second rotating member rotates only in a second rotational direction different from the first rotational direction.

17. The dishwasher of claim 12 wherein the one or more actuators extend the first rotating member between a first radial length and a second radial length, wherein the first radial length is larger than the second radial length.

18. The dishwasher of claim 12 wherein the backing plate engages the shaft and rotates between a second plurality of rotational positions positioning the one or more outlets adjacent the one or more rotating members.

19. The dishwasher of claim 12 wherein the one or more actuators includes a first actuator and a second actuator, wherein the first actuator is positioned at a first radial distance from the rotational axis and the second actuator is positioned at a second radial distance from the rotational axis less than the first radial distance.

20. The dishwasher of claim 12 wherein the backing plate rotates with the shaft of the motor about the rotational axis.

21. A detergent dispenser positioned to dispense detergent into a household appliance, comprising:

a motor with a rotating shaft defining a rotational axis;

a stationary circular blister pack having a plurality of detergents arranged about the rotational axis;

a backing plate adjacent one side of the circular blister pack and having one or more outlets in fluid communication with a wash tub;

one or more elongated rotating members adjacent the other side of the circular blister pack, each one of the one or more elongated rotating members has a first end engaging the shaft of the motor and a second end projecting radially outward therefrom, wherein the one or more elongated rotating members rotate with the shaft about the rotational axis;

wherein the shaft of the motor rotates the second end of the one or more elongated rotating members between a plurality of rotational positions, and wherein one or more of the plurality of rotational positions orients the one or more elongated rotating members adjacent at least one respective detergent of the plurality of detergents and at least one respective outlet of the one or more outlets to dispense the at least one respective detergent into a wash tub; and wherein the one or more elongated rotating members further includes one or more actuators to vary a radial length of the one or more elongated rotating members and/or vary an axial length of the one or more elongated rotating members parallel to the rotational axis.

22. The detergent dispenser of claim 21 wherein the backing plate rotates with the shaft of the motor about the rotational axis.

23. The detergent dispenser of claim 21 wherein the one or more elongated rotating members further includes the one or more actuators to vary the radial length of the one or more elongated rotating members.

24. The detergent dispenser of claim 21 wherein the one or more elongated rotating members further includes the one or more actuators to vary the axial length of the one or more elongated rotating members parallel to the rotational axis.

25. A detergent dispenser positioned to dispense detergent into a household appliance, comprising:

a motor with a rotating shaft defining a rotational axis;

a stationary circular blister pack having a plurality of detergents arranged about the rotational axis;

a backing plate adjacent one side of the circular blister pack and having one or more outlets in fluid communication with a wash tub;

one or more elongated rotating members adjacent the other side of the circular blister pack, each one of the one or more elongated rotating members has a first end engaging the shaft of the motor and a second end projecting radially outward therefrom, wherein the one or more elongated rotating members rotate with the shaft about the rotational axis;

wherein the shaft of the motor rotates the second end of the one or more elongated rotating members between a plurality of rotational positions, and wherein one or more of the plurality of rotational positions orients the one or more elongated rotating members adjacent at least one respective detergent of the plurality of detergents and at least one respective outlet of the one or more outlets to dispense the at least one respective detergent into a wash tub; and wherein the backing plate rotates with the shaft of the motor about the rotational axis.

26. A dishwasher comprising:

a wash tub; and a detergent dispenser positioned in the wash tub to dispense detergent into the wash tub including a motor with a rotating shaft defining a rotational axis;

a stationary circular blister pack having a plurality of detergents arranged about the rotational axis;

a backing plate adjacent one side of the circular blister pack and having one or more outlets in fluid communication with the wash tub;

one or more rotating members adjacent the other side of the circular blister pack, each one of the one or more rotating members has a first end engaging the shaft of the motor and a second end projecting radially outward therefrom, wherein the one or more rotating members rotate with the shaft about the rotational axis;

wherein the shaft of the motor rotates the second end of the one or more rotating members between a first plurality of rotational positions, and wherein one or more of the first plurality of rotational positions orients the one or more rotating members adjacent at least one respective detergent of the plurality of detergents and at least one respective outlet of the one or more outlets to dispense the at least one respective detergent into the wash tub; and wherein the backing plate engages the shaft and rotates between a second plurality of rotational positions positioning the one or more outlets adjacent the one or more rotating members.

* * * * *